US007967519B2

(12) United States Patent
Gueret

(10) Patent No.: US 7,967,519 B2
(45) Date of Patent: Jun. 28, 2011

(54) DEVICE FOR PACKAGING AND APPLYING A SUBSTANCE, THE DEVICE INCLUDING A WIPER MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 977 days.

(21) Appl. No.: 10/849,003

(22) Filed: May 20, 2004

(65) Prior Publication Data

US 2004/0258453 A1 Dec. 23, 2004

Related U.S. Application Data

(60) Provisional application No. 60/484,285, filed on Jul. 3, 2003.

(30) Foreign Application Priority Data

May 27, 2003 (FR) ..... 03 06449

(51) Int. Cl.
*A46B 17/08* (2006.01)

(52) U.S. Cl. ..... 401/122; 401/121

(58) Field of Classification Search ..... 401/122, 401/121, 123, 126, 118
See application file for complete search history.

(56) References Cited

U.S. PATENT DOCUMENTS

| | | | | |
|---|---|---|---|---|
| 2,627,619 | A * | 2/1953 | Gagen | 401/122 |
| 3,529,899 | A | 9/1970 | Gruska | |
| 4,194,848 | A * | 3/1980 | Kingsford | 401/122 |
| 4,390,298 | A * | 6/1983 | Carluccio | 401/122 |
| 4,433,928 | A | 2/1984 | Kingsford | |
| 5,490,737 | A * | 2/1996 | Gueret | 401/122 |
| 5,791,800 | A * | 8/1998 | Katz | 401/122 |
| 5,803,638 | A * | 9/1998 | Gueret | 401/122 |
| 6,280,112 | B1 * | 8/2001 | Vieu | 401/122 |
| 6,315,140 | B1 * | 11/2001 | Nadel | 401/122 |
| 2003/0196672 | A1 | 10/2003 | Kirita et al. | |

FOREIGN PATENT DOCUMENTS

| | | |
|---|---|---|
| EP | 0 627 182 B1 | 12/1994 |
| EP | 0 728 426 B1 | 8/1996 |
| EP | 0 824 329 B1 | 2/1998 |
| FR | 2562773 A1 | 10/1985 |
| JP | U-02-40318 | 3/1990 |
| JP | U-03-103014 | 10/1991 |

* cited by examiner

*Primary Examiner* — Khoa D Huynh

(74) *Attorney, Agent, or Firm* — Oliff & Berridge, PLLC

(57) ABSTRACT

A device for packaging and applying a substance includes: a receptacle for containing a substance; an applicator including an applicator element; and a wiper member for wiping the applicator element, wherein the wiper member includes a longitudinally split annular portion having a wall including at least one slot extending to a free end of the wiper member, the slot passing through an entire thickness of the wall. The split portion may have, in a plane in which an inside cross-section thereof is at a minimum, an outside cross-section that is greater than a maximum cross-section of the applicator element. The split portion deforms radially outward when the applicator element passes therethrough.

56 Claims, 5 Drawing Sheets

DEVICE FOR PACKAGING AND APPLYING A SUBSTANCE, THE DEVICE INCLUDING A WIPER MEMBER

CROSS-REFERENCE TO RELATED APPLICATIONS

This non-provisional application claims the benefit of French Application No. 03 06449 filed on May 27, 2003 and U.S. Provisional Application No. 60/484,285 filed on Jul. 3, 2003, the entire disclosures of which are incorporated by reference herein.

FIELD OF INVENTION

The present invention relates to devices for packaging and applying substances, for example cosmetics or other care products, each device including a wiper member.

BACKGROUND

French patent application FR 2,562,773 discloses a makeup set, in particular for the eyelashes, that comprises a receptacle provided with a wiper member. The receptacle defines a threaded neck suitable for having screwed thereon a stopper that includes an applicator.

European patent EP 0,728,426 B1 describes a device for dispensing a liquid or semisolid substance. The device includes a wiper member which is provided with a plurality of longitudinal slots made through a central portion shaped like the inside of a torus.

European patent EP 0,627,182 B1 discloses a kit for applying a fluid, in particular a cosmetic. The kit includes a wiper member having two stages constituted by two parts, one of which is covered in fibers by flocking.

European patent EP 0,824,329 B1 describes a wiper member comprising a split block of foam.

SUMMARY OF THE INVENTION

Exemplary embodiments of the invention further improve devices for packaging and applying substances. In particular, exemplary embodiments of the invention advantageously include a wiper member capable of wiping a wide variety of applicator elements in a satisfactory manner, for example, applicator elements of cross-section that is not circular.

Exemplary embodiments of the invention have a wiper member that can easily be mounted on a corresponding receptacle.

Exemplary embodiments of the invention provide a device for packaging and applying a substance, such as, for example, a cosmetic or other care product, the device comprising: a receptacle for containing the substance; an applicator including an applicator element; and a wiper member for wiping the applicator element, wherein the wiper member includes a longitudinally split annular portion having a wall that includes at least one slot extending to a free end of the wiper member, the slot passing through an entire thickness of said wall, said split portion having, in a plane where an inside cross-section thereof is at a minimum, an outside cross-section that is greater than a maximum cross-section of the applicator element, the split portion deforming radially outward when the applicator element passes therethrough.

According to various exemplary embodiments of the invention, the wiper member is capable of deforming easily when the applicator element passes therethrough, but without such deformation causing the wiper member to lose its capacity for wiping.

In exemplary embodiments, a slot defines two sectors disposed on either side thereof. In such embodiments, two adjacent sectors separated by a slot thus have facing faces that are spaced apart by a width of the slot. As the applicator element goes through the wiper member, the applicator element can come into contact with the facing faces, which can contribute to wiping, particularly since they are of relatively large area. According to exemplary embodiments, having an outside cross-section of the split portion greater than that of the applicator element enables a relatively large wall thickness to be obtained at a level of the slot, thereby improving wiping.

In exemplary embodiments, the split portion may include at least one portion in relief projecting radially outward, such as, for example, an annular bead. In such embodiments, the projecting portion may be situated substantially at a free end of the split portion, thereby making it possible to benefit from a greater wall thickness at the free end of the split portion and from further improvement in the wiping performance of the wiper member.

In exemplary embodiments, the portion in relief may be other than an annular bead.

In exemplary embodiments, the split portion may include, for example, at least one rib disposed at a slot. In such embodiments, the rib may possibly extend parallel to an axis of the wiper member.

In exemplary embodiments, the thickness of the wall of the split portion may lie, for example, in the range of about 0.5 millimeters (mm) to about 8 mm. In other exemplary embodiments, the thickness may preferably lie in the range of about 0.8 mm to about 6 mm. In still further exemplary embodiments, the thickness may lie in the range of about 1.2 mm to about 6 mm.

The wall thickness of the wiper member need not be constant. For example, the wall thickness in a bottom part of the wiper member need not be constant. Further, in embodiments, the wall thickness in the split portion need not be constant. As shown in FIG. 1B, in an embodiment, a thickness of the wall of the wiper member is not constant.

In exemplary embodiments, in the split portion, the wall thickness may, for example, be such that the applicator element does not project beyond an outer perimeter of the wiper member, remaining masked within the wiper member and being wiped in the thickness of the slots, on passing through the wiper member.

In exemplary embodiments, the split portion may be made, for example, by injecting an elastically deformable material that is flexible to semirigid, for example, having a hardness lying in the range of about 15 on the Shore A scale to about 40 on the Shore D scale. In exemplary embodiments, the material may be solid, without cells.

In exemplary embodiments, the split portion may be made, for example, out of one of the following materials: silicone elastomer, ethylene propylene diene (EPDM), nitrile rubber, butyl rubber, latex, thermoplastic elastomer, polyurethane (PU), polyester, polyethylene (PE), polyvinyl chloride (PVC), ethylene vinyl acetate (EVA), styrene-isoprene-styrene (SIS), styrene butadiene styrene block copolymer (SBS), styrene-ethylene-butaliene-styrene (SEBS), Hytrel®, and Pebax®, although this list is not exhaustive or limiting.

In exemplary embodiments, the split portion may preferably include at least two longitudinal slots, or even better, at least three longitudinal slots. In other exemplary embodiments, the split portion may more preferably include more than four longitudinal slots, such as, for example, more than six or eight. In exemplary embodiments, the slots may preferably be distributed regularly around a circumference of the split portion, the sectors formed between the slots then having a same angular extent.

In exemplary embodiments, the slot(s) may have edges that touch in the absence of the applicator element being engaged in the wiper member.

In exemplary embodiments, a length of at least one slot measured along a longitudinal axis of the wiper member may lie in the range of about 2 mm to about 15 mm, for example.

In exemplary embodiments, the slot(s) may extend over less than half a height, or less than one-third the height, of the wiper member.

In exemplary embodiments, the slot(s) may be made in a portion of the wiper member which extends therealong and which is such that an inside cross-section of the wiper member in said portion is smaller than or equal to a largest cross-section of the applicator element.

In exemplary embodiments, at rest, in the absence of the applicator element, the wiper member may have axial symmetry. In exemplary embodiments, an outside envelope of the wiper member may, for example, be generally in the form of a body of revolution. In exemplary embodiments, the split portion may have an inside cross-section that is circular, oval, or polygonal, such as, for example, square or triangular. In embodiments, a non-circular inside cross-section may be intended, for example, for wiping an applicator member of cross-section that is likewise non-circular, such as, for example, of similar shape.

In exemplary embodiments, the inside cross-section of the split portion, for example, when circular, oval, or polygonal in shape, may taper over at least a certain distance in a direction toward a free end thereof, so as to facilitate insertion of the applicator element into the receptacle. In exemplary embodiments, the inside cross-section of the split portion may taper all the way to the free end of the split portion.

In exemplary embodiments, for example, the split portion may have an inside surface which is generally frustoconical, at least in part.

In exemplary embodiments, the split portion may have, at least over a certain distance, an outside cross-section that tapers progressively toward the free end of the wiper member, converging toward an inside of the receptacle.

In exemplary embodiments, the inside diameter of a top end of the wiper member may be about 10 mm, for example, and may decrease by at least 30%, for example, by about 40% to 6 mm or even less at the free end of the split portion of the wiper member.

In exemplary embodiments, the diameter of the stem may be about 3 mm, for example, and the largest diametrical dimension of the applicator element may be about 6 mm, for example.

In exemplary embodiments, the outer periphery of the wiper member may be of a diameter that is considerably greater than 6 mm, for example.

In exemplary embodiments, the smallest inside section of the wiper member may be smaller than or equal to the diameter of the stem and/or the diameter of the largest cross-section of the applicator element.

In exemplary embodiments, an outside surface of the wiper member may include a groove above the split portion. In embodiments, the groove can facilitate outward deformation of the sectors while the applicator element is passing therethrough.

In exemplary embodiments, the wiper member may also have an annular bead on an outside surface thereof above the split portion, for example, for the purpose of snap-fastening inside the receptacle.

In exemplary embodiments, at least one slot of the split portion may have facing faces that are not parallel. For example, in such embodiments, the split portion may have a cross-section that diverges radially outward, for example, so as to be V-shaped.

In such embodiments, such a split portion can serve to make it easier to deposit a coating of flocking on the facing faces of the slot, for example.

In exemplary embodiments, the split portion may be secured to a fixing portion mounted on the receptacle, for example, engaged in a neck of the receptacle.

In exemplary embodiments, the split portion and the fixing portion may be made as a single molding of material.

In other exemplary embodiments, the split portion may be made as one part and the fixing portion may be made as another part, with the two parts being secured to each other.

In exemplary embodiments, at one end, the fixing portion may have a collar for bearing axially against an end edge of the neck of the receptacle.

In exemplary embodiments, the fixing portion may also include an annular skirt arranged to cover a fraction of the neck, on an outside thereof.

In other exemplary embodiments, the fixing portion may also constitute at least the major fraction of the neck of the receptacle and come to bear around an opening of a receptacle that has substantially no neck.

In exemplary embodiments, the fixing portion and the split portion may be made out of different materials. For example, the fixing portion may be made out of a plastics material that is more rigid than the material from which the split portion is made. Such a fixing portion may serve to obtain satisfactory sealing and fastening on the receptacle that is facilitated by the rigidity of the material from which the fixing portion is made. In exemplary embodiments, the fixing portion may be made, for example, out of one of the following materials: polyolefins, such as PE or polypropylene (PP); polyacetal (POM); polyamide (PA); and, polyethylene terephthalate (PET).

In exemplary embodiments, the material constituting the fixing portion may, for example, be impermeable to water and to a solvent(s) present in the substance.

In embodiments in which the split portion and the fixing portion are not made out of the same material by molding, the split portion may be secured to the fixing portion in various ways. For example, the split portion may be secured to the fixing portion by mechanical assembly, by adhesive, or by heat-sealing. In embodiments, the split portion may also be bonded to the fixing portion by one of them being overmolded on the other.

In exemplary embodiments, the split portion may comprise a fraction of a part that covers the fixing portion, for example, that covers an inside of the fixing portion. In such embodiments, said fraction may taper toward an opening for inserting the applicator element into the wiper member.

In exemplary embodiments, the split portion may be made with a part having a portion for mechanical assembly to the fixing portion, such as, for example, by snap-fastening. In such embodiments, said part may comprise, for example, a groove or a bead for engaging a portion in relief of complementary shape provided on the fixing portion.

In exemplary embodiments, the applicator element may have a variety of shapes. For example, the applicator element may have a cross-section that is not circular over at least a fraction of a length of the applicator element, such as, for example, a cross-section that is flat.

In exemplary embodiments, the applicator element may include a coating of flocking.

In exemplary embodiments, the substance may be a mascara. In exemplary embodiments, the applicator element may thus comprise, for example, a brush or a comb, for example, something other than a paintbrush, possibly extending along an axis that is not rectilinear, that is arranged to apply substance on keratinous fibers, for example, the eyelashes, the eyebrows, and/or the hair. In exemplary embodiments, the substance may also be for application to the eyelids, such as, for example, an eyeliner. In exemplary embodiments, the substance may also be for application to the lips.

In exemplary embodiments, the applicator may comprise a stem having the applicator element fixed to an end thereof. In such embodiments, the stem may be of circular cross-section, for example, and may comprise a first fraction with a first cross-section and a second fraction with a second cross-section that is smaller than the first cross-section, said second fraction taking up a position in the split portion of the wiper member when the applicator is in place on the receptacle. Such an arrangement makes it possible to avoid excessively deforming the split portion of the wiper member during storage. The first fraction may extend between the applicator element and the second fraction.

BRIEF DESCRIPTION OF THE DRAWINGS

The invention may be better understood on reading the following detailed description of non-limiting embodiments thereof, and on examining the accompanying drawings, in which.

DETAILED DESCRIPTION OF EXEMPLARY EMBODIMENTS

The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

Figure 1A:
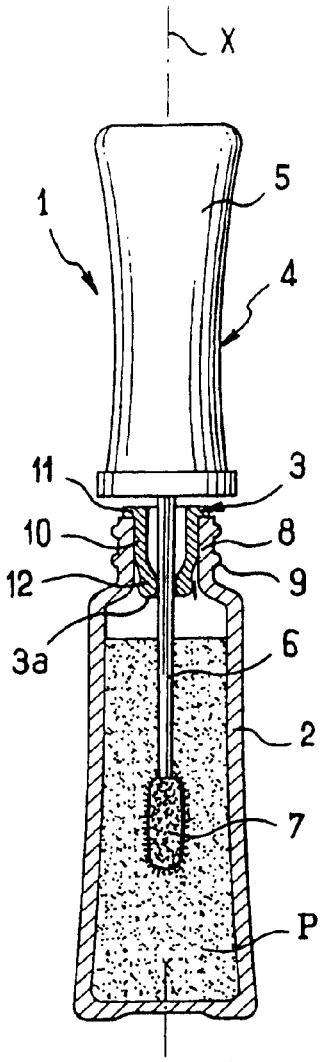
FIG. 1A is a diagrammatic partial axial section view of a packaging and applicator device according to a first exemplary embodiment of the invention.
Figure 3:
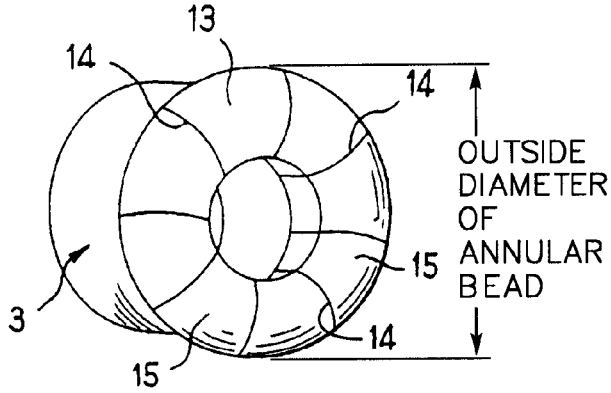
FIG. 3 is a diagrammatic and fragmentary perspective view of showing the first exemplary embodiment of the wiper member of FIG. 2 shown in isolation.

FIG. 1A shows a first exemplary embodiment of a packaging and applicator device 1 comprising a receptacle 2 surmounted by a neck 8 of axis X, open at a top end thereof and suitable for containing a substance P, for example, a cosmetic, such as gloss for the lips.

A wiper member 3 made of an elastically deformable material, for example, a thermoplastic elastomer, is fitted on the receptacle 2 and is secured thereto, for example, by being engaged with friction in the neck 8. The wiper member 3 could be secured to the receptacle 2 in some other way, such as, for example, by adhesive, heat-sealing, or snap-fastening, or by an additional holder part, as desired.

The device 1 further includes an applicator 4 which, in the first exemplary embodiment, comprises a closure cap 5 having a stem 6 secured thereto, a free end of the stem 6 having an applicator element 7, which may be of any desired kind.

In the first exemplary embodiment, the wiper member 3 has a cross-section that is smaller than a cross-section of the applicator element 7.

The cap 5 includes an inside thread (not visible in FIG. 1A) that serves to co-operate with an outside thread 9 on the neck 8 in order to close the receptacle 2. The cap 5 could be secured to the neck 8 other than by screw fastening, for example, by snap-fastening.

In the first exemplary embodiment, the wiper member 3 comprises a generally tubular body 10 with a longitudinal axis that coincides with the axis X of the neck 8. The tubular body 10 is extended at a top end thereof by a collar 11 that rests against a top end of the neck 8.

The collar 11 contributes to obtaining a leaktight closure of the receptacle 2, with the cap 5 having a surface that presses against said collar 11 when the cap is screwed home.

At a bottom end thereof, the wiper member 3 comprises a split annular portion 12 which is provided at an end thereof with a bead 13 that projects radially from an outside surface thereof.

In the first exemplary embodiment, the split portion 12 includes a plurality of longitudinal slots 14 extending parallel to the axis X to a free end 3*a* of the wiper member 3. The slots 14 are eight in number, for example. In the first exemplary embodiment, the slots 14 extend over less than half a height of the wiper member 3, and still in this example, the slots 14 extend over less than one-third the height of the wiper member 3.

Still in the first exemplary embodiment, an outside cross-section of the wiper member 3 is circular, as is an inside cross-section thereof. An inside diameter of the wiper member 3 in its narrowest portion as defined by the split portion 12 is substantially equal to the outside diameter of the stem 6. it is also contemplated by the present invention that the inside diameter of the wiper member 3 in its narrowest portion defined by the split portion 12 may be smaller than the outside diameter of the stem 6.

The diameter of the stem 6 may be 3 mm and the largest diametral dimension of the applicator element 6 may be 6 mm, for example, with the inside diameter of a top end of the wiper member 3 being about 10 mm, for example, and decreasing by 30%, or even 40% at least to 6 mm or less at the free end 3*a* of the wiper member.

The outer periphery of the wiper member 3 may be of a diameter that is considerably greater than 6 mm, for example. In other words, a thickness of a wall in the split portion 12 may be such that the applicator element 7 does not project beyond an outside perimeter of the wiper member 3.

Figure 1B:
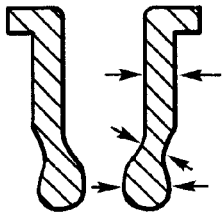
FIG. 1B is an enlarged diagrammatic view partially in axial section and partially in perspective of the wiper member made in accordance with the invention.

When the applicator device 1 is closed, as shown in FIG. 1, the split portion 12 of the wiper member 3 bears against the stem 6 of the applicator 4 without significant deformation of the split portion 12.

The slots 14 define sectors 15 therebetween that are capable of splaying apart when the applicator element 7 passes therethrough.

In the first exemplary embodiment, the slots 14 are distributed in a regular manner around the split portion 12, and the sectors 15 are all of the same angular extent.

Nevertheless, the present invention contemplates that the slots 14 may be separated in irregular manner around the split portion 12.

In the first exemplary embodiment, the applicator element 7 is covered in a coating of flocking and is generally flat in shape. The cross-section of the applicator element 7 is non-circular, being oblong in shape with a major dimension that is greater than the diameter of the stem 3, for example, at least 1.5 times said diameter, or even at least twice said diameter.

Figure 4:
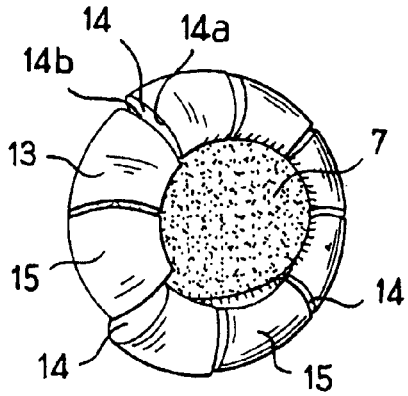
FIGS. 4 and 5 are diagrammatic and fragmentary views illustrating the exemplary applicator element of FIG. 1A passing through the exemplary wiper member of FIGS. 2 and 3.
Figure 5:
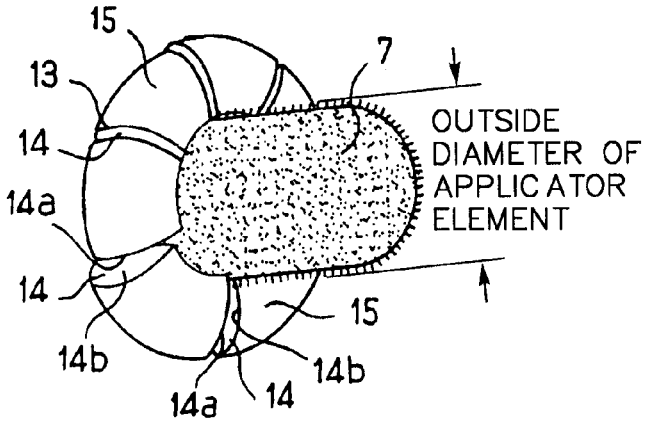

FIGS. 4 and 5 illustrate the applicator element 7 going through the split portion 12. The sectors 15 bend so as to allow the split portion 12 to fit closely around the shape of the applicator element 7 as the applicator element 7 passes therethrough, thereby ensuring that the applicator element 7 is wiped effectively.

In the first exemplary embodiment, the slots 14 are made in a portion of the wiper member 3 that extends along the wiper member 3 and that is such that the inside cross-section of the wiper member 3 in said portion is less than or equal to the largest or maximum cross-section of the applicator element 7.

The applicator element 7 may also be wiped in part by the facing faces 14*a* and 14*b* of at least one slot 14, for example, in the vicinity of the bead 13, as shown in FIG. 5.

For example, the thickness of the split portion 12 may be such that the applicator element 7 does not project beyond the outer periphery of the wiper member 3, the applicator element 7 remaining masked therein, and being wiped in the thickness of the slots 14 as the applicator element 7 goes through the wiper member 3.

The faces 14*a* and 14*b* are best placed for contributing to wiping when they are capable of coming into contact with the applicator element 7. Where appropriate, substance may be retained between the faces 14*a* and 14*b* by capillarity. The relatively great thickness of the wall of the split portion 12, for example, in the vicinity of the bead 13, enables the faces 14*a* and 14*b* to be of relatively large area, and thus suitable for contributing to wiping the applicator element 7 and picking up substance P by capillarity.

Given the elasticity of the wiper member 3, once the applicator element 7 has passed through the split portion 12, the slots 14 close, with the sectors 15 again being substantially in contact with one another.

Figure 6:
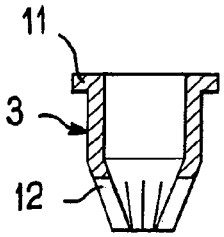
FIGS. 6 and 7 are diagrammatic axial section views of second and third exemplary embodiments of the wiper member.

The wiper member 7 may have a split portion 12 that does not have a bead 13, while still conserving a wall that is relatively thick, for example, being in the form of a truncated cone whose outside cross-section tapers toward the inside of the receptacle. A second exemplary embodiment of such a wiper member 3 is shown in FIG. 6. In FIG. 6, the wiper member 3 has an inside cross-section that tapers downward to the free end 3*a* of the wiper member 3.

The wall thickness of the wiper member 3 may lie in the range of about 0.5 mm to about 8 mm, or indeed in the range of about 0.8 mm to about 6 mm, for example, in the range of about 1.2 mm to about 6 mm.

Figure 7:
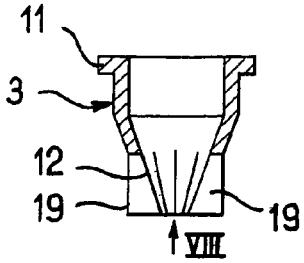
Figure 8:
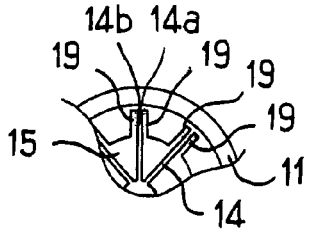
FIG. 8 is a diagrammatic and fragmentary view of the third exemplary embodiment of the wiper member as seen looking along arrow VIII of FIG. 7.
Figure 9:
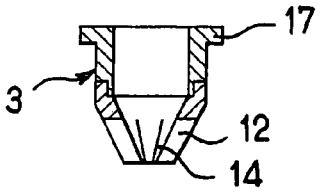
FIGS. 9 to 14 are diagrammatic axial section views of fourth through ninth exemplary embodiments of the wiper member.
Figure 10:
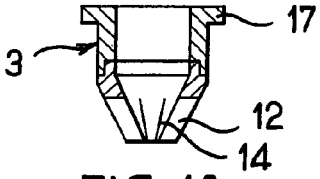
Figure 11:
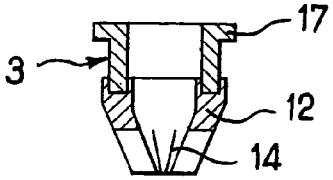

The outside cross-section of the wiper member 3 may also be increased by the presence of axial ribs 19 on the outside portions of the sectors 15. The axial ribs 19 may extend the faces 14*a* and 14*b* of the slots 14, as shown in the third exemplary embodiment of the wiper member 3 of FIGS. 7 and 8.

The wiper member 3 may be made as a single part, as described above, or as two parts that are assembled together.

This applies, for example, for the exemplary embodiments of the wiper members 3 shown in the fourth through ninth exemplary embodiments of the wiper member 3 of FIGS. 9 to 14, each of which comprises a fixing portion 17 made of a material that is relatively rigid, such as a polyolefin, and a part that is fixed to the fixing portion 17 and includes the split portion 12, said part being made of a material that is more flexible than the material of the fixing portion 17, such as, for example, a thermoplastic elastomer.

The fixing portion 17 and the part including the split portion 12 may be fastened together in various ways. For example, they may be fastened by adhesive, by heat-sealing, by snap-fastening, or by being assembled together via an additional part. The part including the split portion 12 may engage, for example, around the fixing portion 17, as shown in the fourth exemplary embodiment of FIG. 9, inside the fixing portion 17, as shown in the fifth exemplary embodiment of FIG. 10, or astride the fixing portion 17, as shown in the sixth exemplary embodiment of FIG. 11.

Figure 12:
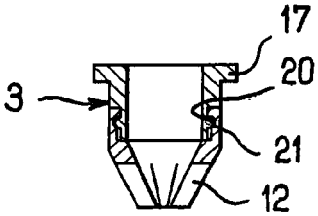

In the seventh exemplary embodiment of FIG. 12, the fixing portion 17 and the part that includes the split portion 12 are held together mechanically by snap-fastening. The fixing portion 17 has a bead 20 and the part including the split portion 12 has a groove 21 for receiving the bead 20.

Figure 13:
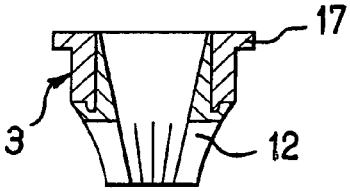

The fixing portion 17 and the split portion 12 may also be secured to each other by overmolding. For example, the part including the split portion 12 may be made by dual injection onto the fixing portion 17, as shown in the eighth exemplary embodiment of FIG. 13. In FIG. 13, the part including the split portion 12 covers the inside of the fixing portion 17.

Figure 14:
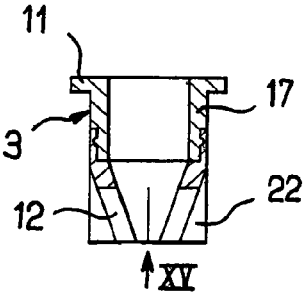
Figure 15:
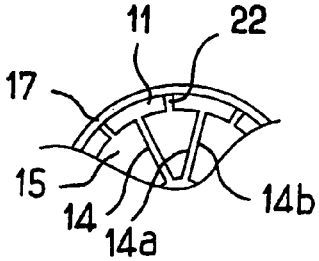
FIG. 15 is a diagrammatic and fragmentary view of the ninth exemplary embodiment as seen looking along arrow XV of FIG. 14.

The split portion 12 of the wiper member 3 may include ribs 22 disposed substantially in the middle of each outside portion of the sectors 15, thus making it possible to obtain greater stiffness for the split portion 12, as shown in ninth exemplary embodiment of FIGS. 14 and 15.

Figure 16:
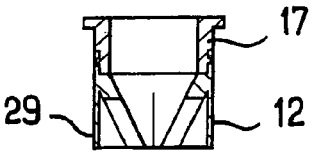
FIG. 16 is a diagrammatic axial section view of a tenth exemplary embodiment of the wiper member.

As shown in the tenth exemplary embodiment of the wiper member 3 of FIG. 16, the part including the split portion 12 may be provided with an outer annular skirt 29 extending around the split portion 12. The outer annular skirt 29 may serve, for example, to retain the substance.

Figure 17:
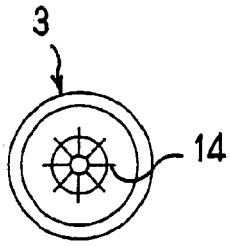
FIGS. 17 to 20 are diagrammatic views of various exemplary embodiments of the split portion of the wiper member, analogous to the views of FIGS. 8 and 15.

The inside cross-section of the split portion 12 may be circular and may have a diameter substantially equal to the diameter of the stem 6, or may have a diameter smaller than that of the stem 6, as shown in the exemplary embodiment of FIG. 17, so as to be adapted, for example, to wiping an applicator element having a tapering portion. The inside cross-section of the split portion 12 need not be circular. For example, the inside cross-section may be star-shaped, as shown in the exemplary embodiment of FIG. 18, so as to perform partial and selective wiping of the applicator element, for example.

Figure 18:
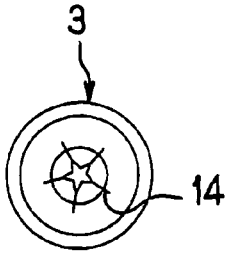
Figure 19:
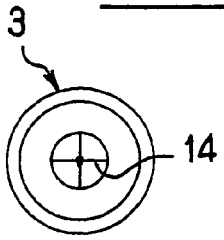
Figure 20:
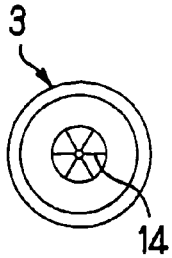

The number of slots 14 may vary. For example, the exemplary embodiment of FIG. 18 shows a wiper member 3 having five slots 14, while the exemplary embodiment of FIG. 19 shows four slots 14, and the exemplary embodiment of FIG. 20 shows six slots 14.

Figure 21:
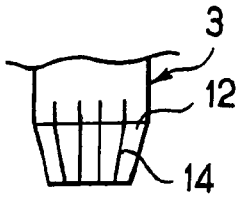
FIGS. 21 to 24 are diagrammatic and fragmentary side views of eleventh through fourteenth exemplary embodiments of the wiper member.
Figure 22:
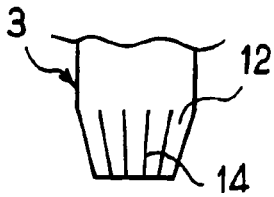

When the wiper member 3 has a portion of frustoconical shape with a cross-section that tapers progressively downward, the slots 14 may extend over a fraction only of the frustoconical portion, as shown in the second exemplary embodiment of FIG. 6. The slots 14 may also extend beyond the frustoconical portion, as shown in the eleventh exemplary embodiment of FIG. 21, or they may extend only over the frustoconical portion, as shown in the twelfth exemplary embodiment of FIG. 22.

Figure 23:
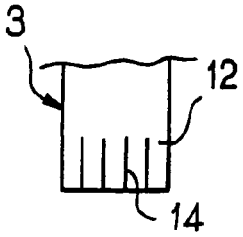

The split portion 12 may be generally tubular in shape, as shown in the thirteenth exemplary embodiment of FIG. 23.

Figure 24:
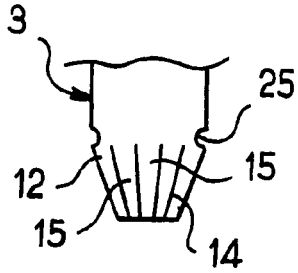

The wiper member 3 may have an outside section that narrows at one location, for example, to form a groove 25, as shown in the fourteenth exemplary embodiment of FIG. 24, for example, for the purpose of enabling the sectors 15 to move away more easily while the applicator element 7 is passing therethrough.

Figure 25:
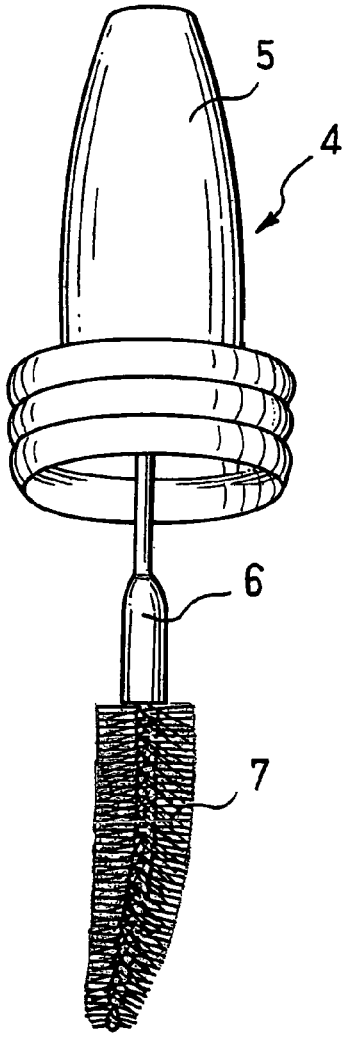
FIG. 25 is a diagrammatic view of an exemplary embodiment of an applicator according to the invention, including an applicator element comprising a brush.

FIG. 25 shows another exemplary embodiment of an applicator 4 according to the invention, in which the applicator element 7 comprises a brush, which may be slightly curved.

Figure 26:
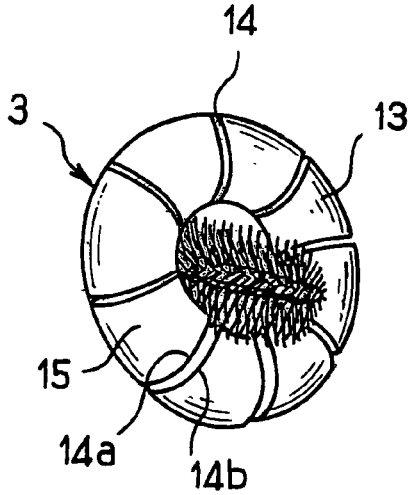
FIG. 26 is a diagrammatic and fragmentary view illustrating the exemplary applicator element of FIG. 25 passing through a wiper member.

FIG. 26 shows the brush 7 passing through the wiper member 3.

Figure 27:
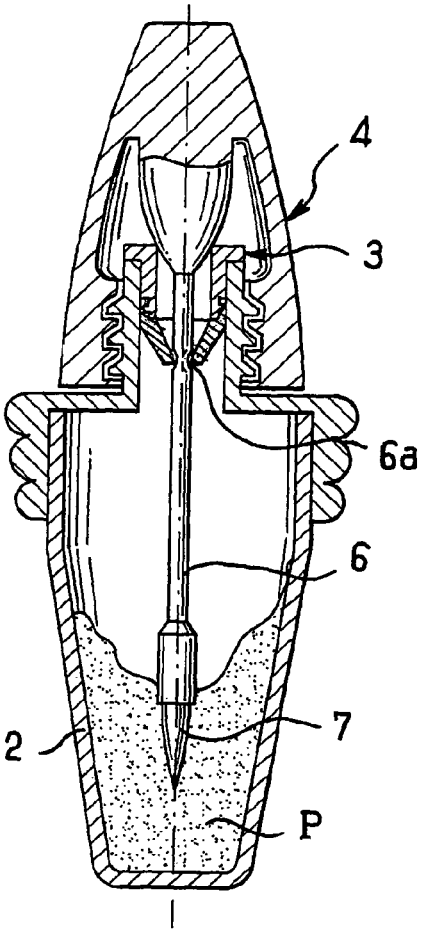
FIG. 27 is a diagrammatic axial section view of a packaging and applicator device according to a second exemplary embodiment of the invention.

FIG. 27 shows a second exemplary embodiment of a packaging and applicator device according to the invention for applying eyeliner. The stem 6 of the applicator 4 has a narrowed portion 6*a* with a cross-section smaller than the inside cross-section of the split portion 12 so as to prevent the sectors 15 from deforming while at rest and so as to make it easier to allow the pressure induced inside the receptacle 2 on insertion of the applicator 4 into the receptacle to escape.

Figure 28:
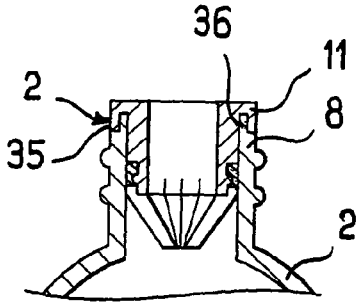
FIGS. 28 and 29 are diagrammatic and fragmentary axial section views of third and fourth exemplary embodiments of a packaging and applicator device according to the invention.

In the third exemplary embodiment of a packaging and applicator device according to the invention, as shown in FIG. 28, the fixing portion 17 of the wiper member 3 has an annular skirt 35 that covers a lip 36 made at the top end of the neck 8. This improves retention of the wiper member 3.

Figure 29:
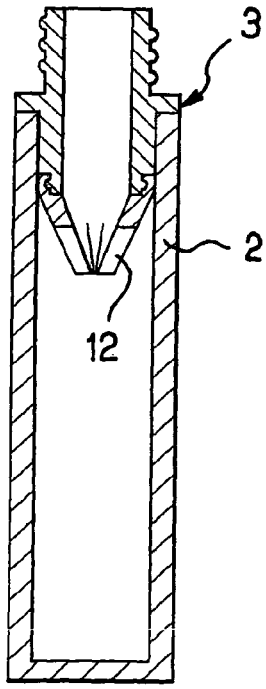

In the fourth exemplary embodiment of a packaging and applicator device according to the invention, as shown in FIG. 29, the wiper member 3 is made with a neck onto which it is possible to screw a closure cap 5, for example.

Figure 2:
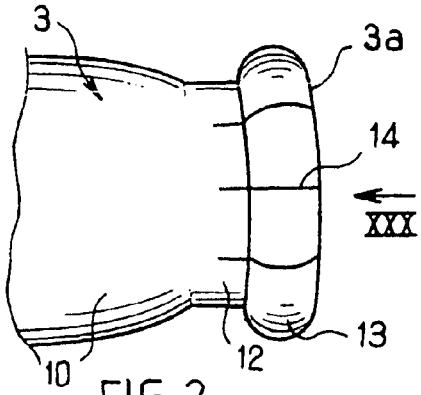
FIG. 2 is a diagrammatic and fragmentary side view of a first exemplary embodiment of the wiper member of the device of FIG. 1A shown in isolation.

In the first exemplary embodiment of FIG. 2, each slot 14 has facing faces 14*a* and 14*b* which are essentially parallel and which touch one another at rest.

However, the present invention contemplates providing the slots 14 differently. For example, slots with facing faces 14*a* and 14*b* that are not parallel at rest may be provided. For example, the slots may have facing faces 14*a* and 14*b* that diverge radially outward, as shown in the fifteenth exemplary embodiment of the wiper member of FIG. 30.

Figure 30:
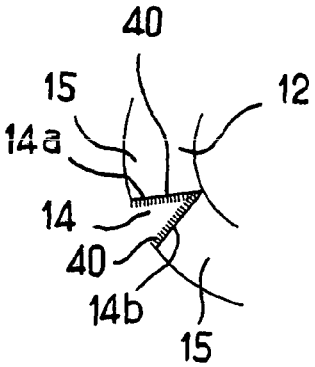
FIG. 30 is a fragmentary and diagrammatic view of a fifteenth exemplary embodiment of the wiper member as seen looking along arrow XXX of FIG. 2.

In FIG. 30, at least one slot 14 of the split portion 12 has a width that increases going outward. This can make it possible, for example, to cover the faces 14*a* and 14*b* more easily in a coating of flocking 40, which can further improve the performance of the wiper member.

Figure 31:
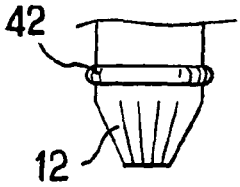
FIG. 31 is a fragmentary elevation view of a sixteenth exemplary embodiment of a wiper member according to the invention.
Figure 32:
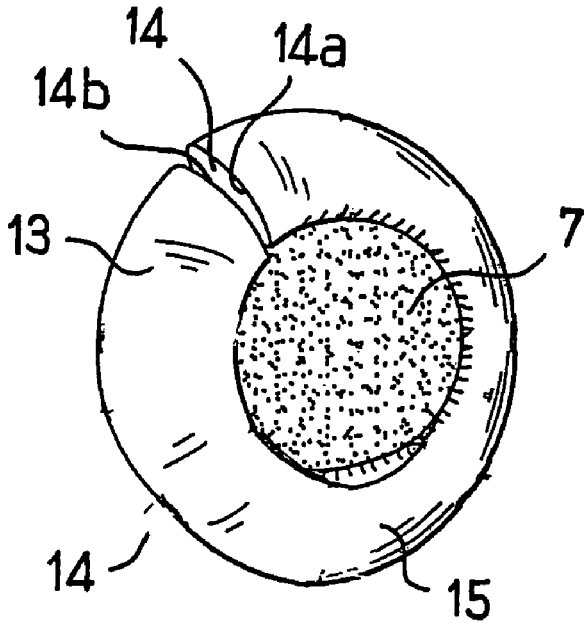
FIGS. 32 and 33 are diagrammatic and fragmentary views illustrating the exemplary applicator element of FIG. 1 passing through an exemplary wiper member having only one slot.
Figure 33:
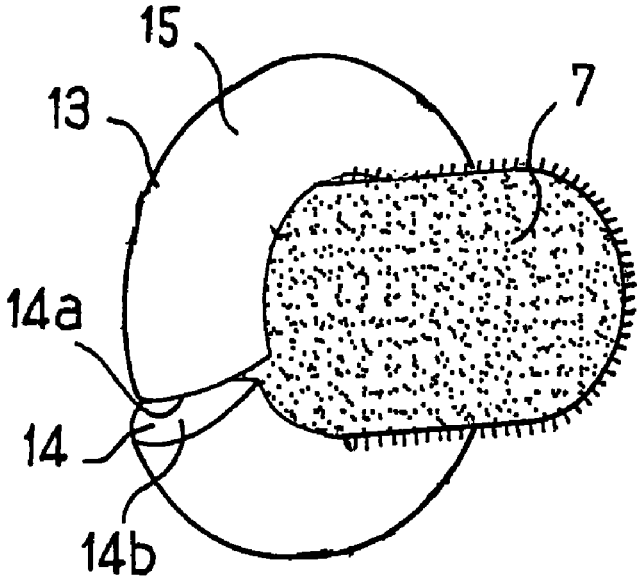

FIG. 31 shows a sixteenth exemplary embodiment of the wiper member with an annular bead 42 that projects from an outside surface thereof, for the purpose of snap-fastening in a corresponding groove of the receptacle, for example, a groove made in the neck of the receptacle.

Naturally, the invention is not limited to the embodiments described above.

The applicator element may have any rounded, elongate, or angled shape. The applicator element may comprise, for example, a rectilinear brush, an optionally flocked foam applicator, a comb, or a paintbrush.

The applicator element may have a maximum cross-section that is smaller than or equal to the maximum diameter of the stem.

Throughout the description, including in the claims, the term "comprising a" should be understood as being synonymous with the term "comprising at least one", unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device for packaging and applying a substance, the device comprising:

a receptacle for containing a substance;

an applicator including a stem with a free end;

an applicator element attached to the free end of the stem; and a wiper member for wiping the applicator element, wherein (a) the wiper member includes a split portion, the split portion including an annular bead, under the condition that the applicator element is outside of the wiper member and inside the receptacle such that the applicator element is not in contact with the wiper member, an outside diameter of the annular bead is larger than an outside diameter of the applicator element, wherein the outside diameter of the applicator element is measured from a radially outermost point on the applicator element to a diametrically opposite radially outermost point on the applicator element, (b) the split portion extends over less than a height of the wiper member and has a wall that includes at least one slot extending to the free end of the wiper member, the slot being defined by opposing faces of the wall, the slot passing through an entire thickness of the wall, (c) the split portion has, in a plane in which an inside cross-section thereof is at a minimum, an outside cross-section that is greater than a maximum cross-section of the applicator element, (d) the split portion deforms radially outward when the applicator element passes therethrough, and (e) when the wiper member is not engaged with the applicator element, the opposing faces of the wall are in substantial contact.

2. A device according to claim 1, wherein the annular bead projects radially outward.

3. A device according to claim 2, wherein the portion in relief comprises at least one rib placed level with the at least one slot.

4. A device according to claim 1, wherein a thickness of the wall of the split portion lies in the range of about 0.5 mm to about 8 mm.

5. A device according to claim 1, wherein a thickness of the wall of the split portion lies in the range of about 0.8 mm to about 6 mm.

6. A device according to claim 1, wherein a thickness of the wall of the split portion lies in the range of about 1.2 mm to about 6 mm.

7. A device according to claim 1, wherein the split portion is made of an elastically deformable material of hardness lying in the range of about 15 on the Shore A scale to about 40 on the Shore D scale.

8. A device according to claim 1, wherein the split portion is made of a material selected from: silicone elastomer; ethylene propylene diene; nitrile rubber; butyle rubber; latex; thermoplastic elastomer; polyurethane; polyester; polyethylene; polyvinyl chloride; ethylene vinyl acetate; styrene-isoprene-styrene; styrene butadiene styrene block copolymer; styrene-ethylene-butaliene-styrene; polyester elastomer; and polyether-block co-polyamide polymer.

9. A device according to claim 1, wherein the split portion includes at least two longitudinal slots.

10. A device according to claim 1, wherein the split portion includes at least three longitudinal slots.

11. A device according to claim 1, wherein the split portion includes more than four longitudinal slots.

12. A device according to claim 1, wherein the split portion includes more than six longitudinal slots.

13. A device according to claim 1, wherein the split portion includes a plurality of slots that are regularly distributed around the circumference of the split portion.

14. A device according to claim 1, wherein the split portion includes at least one slot of length, measured along the longitudinal axis of the wiper member, that lies in the range of about 2 mm to about 15 mm.

15. A device according to claim 1, wherein the wiper member has axial symmetry when at rest and in the absence of an applicator element.

16. A device according to claim 1, wherein the wiper member has an outside envelope that is generally in the form of a body of revolution when at rest and in the absence of an applicator element.

17. A device according to claim 1, wherein the split portion has an inside cross-section that is one of circular, oval, and polygonal.

18. A device according to claim 17, wherein the split portion has an inside cross-section that is one of square and triangular.

19. A device according to claim 1, wherein, at least over a certain distance, an inside cross-section of the split portion tapers in a direction approaching a free end of the split portion.

20. A device according to claim 1, wherein the split portion is secured to a fixing portion mounted on the receptacle.

21. A device according to claim 20, wherein the fixing portion is engaged in a neck of the receptacle.

22. A device according to claim 20, wherein the fixing portion has a collar at one end for bearing axially against an end edge of a neck of the receptacle.

23. A device according to claim 22, wherein the split portion and the fixing portion are made as a single piece by molding material.

24. A device according to claim 22, wherein the split portion is made as one part, and the fixing portion is made as another part, with the two parts being secured to each other.

25. A device according to claim 24, wherein the two parts are made of different materials.

26. A device according to claim 20, wherein the fixing portion is made of a material selected from: polyolefins; polyethylene; polypropylene; polyacetal; polyamide; and polyethylene terephthalate.

27. A device according to claim 24, wherein the two parts are assembled together by a technique selected from: mechanical assembly; adhesive; heat-sealing; and overmolding.

28. A device according to claim 24, wherein the split portion comprises a fraction of a part that covers the fixing portion.

29. A device according to claim 27, wherein the split portion is made in a part which includes a portion arranged to be mechanically assembled with the fixing portion by snap-fastening.

30. A device according to claim 1, wherein the annular bead of the wiper member is configured to snap-fastening inside the receptacle.

31. A device according to claim 1, wherein the at least one slot has a cross-section that diverges radially outward.

32. A device according to claim 1, wherein the at least one slot is V-shaped.

33. A device according to claim 32, wherein the at least one slot has facing faces that are flocked.

34. A device according to claim 1, wherein the wiper member includes a groove in an outside surface thereof above the split portion.

35. A device according to claim 1, wherein a cross-section of the applicator element is not circular over at least a fraction of a length thereof.

36. A device according to claim 1, wherein the applicator element includes a coating of flocking.

37. A device according to claim 1, wherein the applicator element comprises one of a brush and a comb, the applicator element being arranged to apply a substance to one of the eyelashes and the eyebrows.

38. A device according to claim 1, further comprising a substance contained in the receptacle, wherein the substance is for application to keratinous fibers.

39. A device according to claim 1, further comprising a substance contained in the receptacle, wherein the substance is for application to one of the lips and the eyelids.

40. A device according to claim 1, wherein the applicator comprises a stem having the applicator element fastened to an end thereof.

41. A device according to claim 40, wherein the stem comprises a first portion with a first cross-section and a second portion with a second cross-section smaller than the first cross-section, said second portion being positioned in the split portion of the wiper member when the applicator is in place on the receptacle.

42. A device according to claim 1, wherein an inside cross-section of the split portion tapers to a free end of the split portion.

43. A device according to claim 1, wherein a thickness of the wall of the wiper member is not constant.

44. A device according to claim 1, wherein a thickness of the wall of the wiper member is not constant over a bottom half of the wiper member.

45. A device according to claim 1, wherein a thickness of the wall of the wiper member is not constant over the split portion.

46. A device according to claim 1, wherein a thickness of the wall in the split portion is such that the applicator element does not project beyond an outside perimeter of the wiper member, such that the applicator element remains masked within the wiper member, and is wiped in a thickness of the at least one slot as the applicator element passes through the wiper member.

47. A device according to claim 1, wherein the at least one slot extends over less than half a height of the wiper member.

48. A device according to claim 1, wherein the at least one slot extends over less than one-third of a height of the wiper member.

49. A device according to claim 1, wherein the at least one slot is made in a portion of the wiper member that extends therealong and that is such that an inside cross-section of the wiper member over said portion is less than or equal to a maximum cross-section of the applicator.

50. A device according to claim 1, wherein the split portion includes more than eight longitudinal slots.

51. A device according to claim 1, further comprising a cosmetic contained in the receptacle.

52. A device according to claim 1, further comprising a care product contained in the receptacle.

53. A device according to claim 1, wherein the applicator element has a raised surface.

54. A device according to claim 53, wherein the raised surface is flocking.

55. A device according to claim 53, wherein the raised surface is bristles.

56. A device according to claim 1, wherein when the wiper member is engaged with the applicator element, the applicator element does not project beyond the outer periphery of the wiper member.

* * * * *